US005250166A

United States Patent [19]

Motojima et al.

[11] Patent Number: 5,250,166

[45] Date of Patent: Oct. 5, 1993

[54] METHOD OF RECOVERING PALLADIUM BY ELECTROLYSIS AND APPARATUS THEREFOR

[75] Inventors: Kenji Motojima; Misato Horie, both of Mito; Shin-ichiro Torada, Ibaraki, all of Japan

[73] Assignees: Doryokuro Kakunenryo Kaihatsu Jigyodan; Johoku Chemical Co., Ltd., Tokyo, Japan

[21] Appl. No.: 873,620

[22] Filed: Apr. 22, 1992

Related U.S. Application Data

[63] Continuation of Ser. No. 761,242, Sep. 17, 1991, abandoned.

[30] Foreign Application Priority Data

Sep. 21, 1990 [JP] Japan ..... 2-252283

[51] Int. Cl.[5] ..... C25C 7/02; C25C 7/08

[52] U.S. Cl. ..... 204/222; 204/109; 204/227; 204/231; 204/273; 204/275

[58] Field of Search ..... 204/109, 111, 222, 227, 204/231, 273, 275, 284, 290 R

[56] References Cited

U.S. PATENT DOCUMENTS 3,891,741 6/1975 Carlin et al. ..... 204/109
4,425,204 1/1984 McLaughlin ..... 204/222

FOREIGN PATENT DOCUMENTS 2731698 1/1978 Fed. Rep. of Germany .
5224919 2/1977 Japan .

*Primary Examiner*—John Niebling
*Assistant Examiner*—Brian M. Bolan
*Attorney, Agent, or Firm*—Wenderoth, Lind & Ponack

[57] ABSTRACT

A method of recovering palladium from a palladium-containing aqueous solution by electrolysis is provided. The method comprises the steps of dc-electrolyzing the palladium-containing aqueous solution acidified with nitric acid by using an electrolytic cell equipped with a platinum electrode as a cathode to thereby deposit and collect palladium on the cathode, taking the cathode on which palladium has been deposited and collected out of the electrolytic cell, transferring the palladium-deposited cathode to a recovery vessel containing dilute nitric acid therein, and mechanically shaking the cathode in the recovery vessel to remove and recover palladium from the cathode. An apparatus for carrying out the above-described method is also provided.

5 Claims, 1 Drawing Sheet

METHOD OF RECOVERING PALLADIUM BY ELECTROLYSIS AND APPARATUS THEREFOR

This application is a continuation of now abandoned application Ser. No. 07/761,242, filed Sep. 17, 1991.

BACKGROUND OF THE INVENTION

The present invention relates to a method of recovering palladium simply and effectively by electrolysis from an aqueous solution containing palladium and acidified with nitric acid, and also relates to an apparatus for carrying out the method.

The present invention is particularly useful in recovering palladium from radioactive liquid waste containing a plurality of elements of the platinum group, such as palladium, ruthenium and the like, which are nuclear fission products.

In most of the reported research for the separation and recovery of palladium from radioactive liquid waste or the like containing palladium, a chemical process of forming a precipitate or complex out of a solution is generally used.

In general industries, on the other hand, most processes for the separation and purification of palladium from palladium containing solutions employ solvent extraction.

The conventional process that depends on the formation of a precipitate or complex for the separation and recovery of palladium from radioactive liquid waste requires that a chemical substance containing an element to form the precipitate or complex be added from the outside into the liquid waste. This consequently brings about the increase in the amount of the waste to be treated. From the viewpoint of radioactive waste disposal, the increase in the amount of waste by the addition of the extra chemical substance from the outside is inadvisable. Moreover, the process involves complicated settings of operation conditions since it needs precise control of conditions, such as the additive concentrations and stoichiometric ratio, to suppress side reactions and optimize the chemical reactions.

Solvent extraction likewise necessitates a troublesome procedure of extracting palladium from a solution by the action of other chemical substance such as a solvent and further recovering palladium from the extract.

SUMMARY OF THE INVENTION

An object of the present invention is to provide a method and apparatus for recovering palladium in a quite simplified and effective manner without the necessity of adding any other reagent or solvent to a palladium-containing solution.

Another object of the present invention is to provide a method and apparatus for recovering palladium which is free from cumbersome control of reaction conditions and other factors.

According to the present invention, there is provided a method of recovering palladium by electrolysis comprising the steps of dc(direct current-electrolyzing a palladium-containing aqueous solution acidified with nitric acid by using an electrolytic cell equipped with a platinum electrode as a cathode to thereby deposit and collect palladium on the cathode, taking the cathode on which palladium has been deposited and collected out of the electrolytic cell, transferring the palladium-deposited cathode to a recovery vessel containing dilute nitric acid therein, and mechanically shaking the cathode in the recovery vessel to remove and recover palladium from the cathode.

According to the present invention, there is also provided an apparatus for recovering palladium by eletrolysis comprising a dc electrolytic cell capable of receiving therein a palladium-containing aqueous solution acidified with nitric acid and equipped with a platinum electrode as a cathode, a recovery vessel capable of receiving therein dilute nitric acid and equipped with a mechanical shaker, and an electrode-transferring mechanism for taking out the cathode from the electrolytic cell and inserting the cathode into the recovery vessel.

For even more effective separation and removal of palladium deposited and collected on the cathode in the recovery vessel, it is desirable to subject the cathode to mechanical shaking and conduct ac (alternating current) electrolysis with a counter electrode located opposite to the electrode.

PREFERRED EMBODIMENTS OF THE INVENTION

The invention will be more fully described below with reference to the accompanying drawings.

Figure 1:
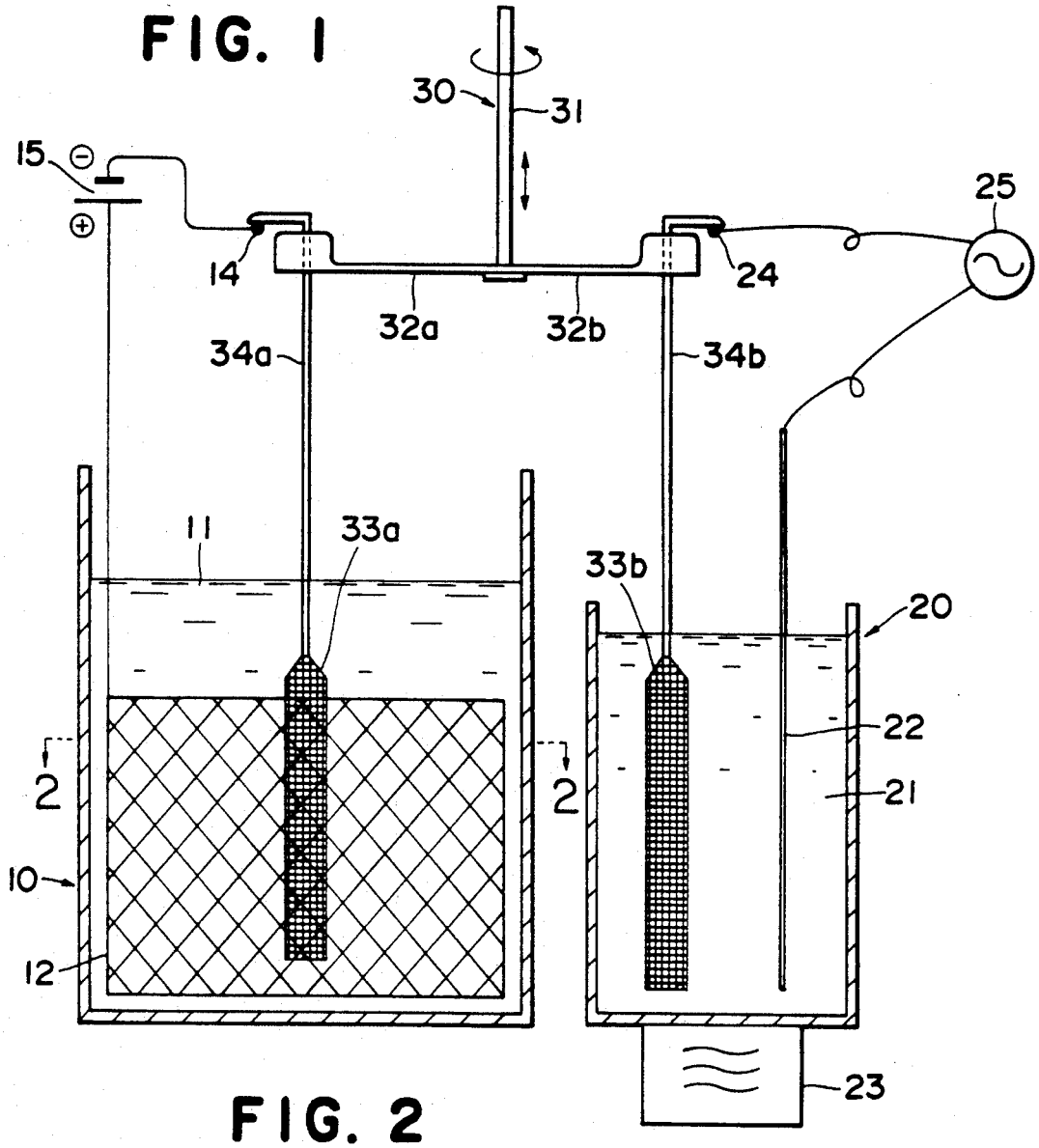
FIG. 1 is a schematic view of a preferred embodiment of a palladium recovery apparatus according to the present invention.
Figure 2:
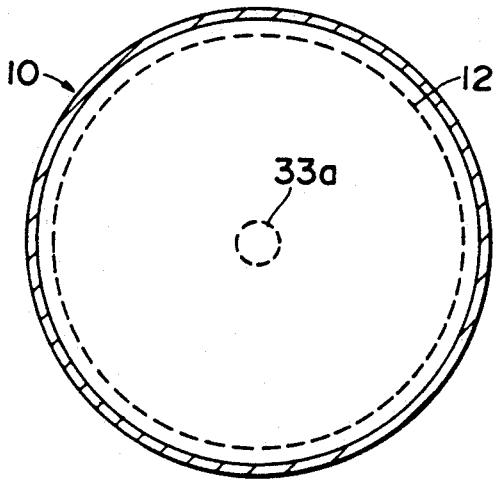
FIG. 2 is a sectional view taken along the line A - A of FIG. 1.

Referring to FIGS. 1 and 2, the apparatus according to the present invention basically comprises a dc electrolytic cell 10, a recovery vessel 20, and an electrode-transferring mechanism 30. The electrolytic cell 10 receives therein an aqueous solution 11 acidified with nitric acid and includes a cylindrical anode 12 of platinum gauze. The recovery vessel 20 receives therein dilute nitric acid 21 and has a counter electrode 22 made of platinum. A mechanical shaker 23, e.g., an ultrasonic vibrator, is attached at the outside of the bottom of the recovery vessel 20. The electrode-transferring mechanism 30 comprises a drive shaft 31 capable of rotating and moving upward and downward and arms 32*a* and 32*b* extending from the shaft horizontally in opposite directions. Platinum electrodes 33*a* and 33*b*that serve as cathodes are suspended perpendicularly from the end portions of the arms via platinum wires 34*a* and 34*b* so that the cathodes 33*a* and 33*b* can be immersed in the electrolytic cell 10 and in the recovery vessel 20, respectively. The platinum electrodes 33*a* and 33*b* are both constructed of slender cylinders of a platinum or platinum-plated inert metal network, and inserted either into the electrolytic cell 10 as a cathode in the center of the cylindrical anode 12 (see FIG. 2) or into the recovery vessel 20 as opposed to the counter electrode 22. When the platinum electrode 33*a* is inserted into a predetermined position within the electrolytic cell 10, the end of the arm 32*a* is electrically connected to a contact 14. The contact 14 is connected to the negative terminal of a dc supply 15, the positive terminal of which is connected to the anode 12. When the platinum electrode 33*b* is set in a predetermined position inside the recovery vessel 20, the end of the arm 32*b* is electrically connected to a contact 24, which in turn is connected to one terminal of an ac supply 25, the other terminal of the ac supply being connected to the counter electrode 22.

An example of the method of the present invention using the above-described apparatus will now be explained in detail. An aqueous solution 11 containing 200 mg of palladium and 300 mg of ruthenium and acidified with 3N nitric acid was placed in the electrolytic cell 10 having a capacity of 3 1 to carry out dc electrolysis under the conditions of about 2 V and 2 A, and palladium was deposited and collected on the cathode 33*a*. At intervals of predetermined periods (from 15 minutes to one hour), the cathode 33*a* was taken out of the electrolytic cell 10 and transferred to the recovery vessel 20 containing 1N nitric acid solution 21. To this end, the drive shaft 31 of the electrode-transferring mechanism 30 was moved vertically and rotated to draw out the cathode 33*a* from the electrolytic cell 10 and insert it into the recovery vessel 20, and draw out the cathode 33*b* from the recovery vessel 20 and insert it into the electrolytic cell 10. Inside the recovery vessel 20, the cathode 33*a* was mechanically shaken to separate a deposit from the cathode. Further, electrolysis with an ac of about 20 V between the cathode and the counter electrode 22 made it possible to remove the deposit more effectively from the cathode surface. The deposit separated and recovered in the recovery vessel 20 was found on analysis to be metallic palladium powder.

Constant-current electrolysis was performed in the electrolytic cell under the above-mentioned conditions for about 6 hours, and the palladium concentration in the solution decreased to approximately one-hundredth of the original level. Since the efficiency of electrolysis declines gradually as the palladium deposit grows on the cathode during the electrolysis, it is necessary, as stated above, to take out the cathode at predetermined intervals of time from the electrolytic cell and transfer it to the recovery vessel and separate and recover the palladium deposit from the cathode.

Preferably, the electrolysis temperature inside the electrolytic cell ranges from room temperature to about 60° C., and the operating temperature inside the recovery vessel is on the ordinary level.

The illustrated apparatus uses an electrode-transferring mechanism having a pair of cathodes to carry out the electrolysis in the electrolytic cell and the recovery in the recovery vessel concurrently and continuously. A single cathode may be employed instead to conduct the electrolysis in the electrolytic cell and the recovery in the recovery vessel alternately and intermittently.

According to the present invention, as described above, palladium separation by an electrolysis is merely effected with a platinum electrode immersed in an aqueous solution acidified with nitric acid. By such an extremely simplified method, palladium is electrochemically collected as a deposit on the electrode and then the deposit is separated from the electrode to isolate palladium. The method entails no such complexity as of controlling reaction conditions in conventional methods for palladium recovery through chemical process. Where palladium is to be recovered from radioactive liquid waste, the method of the present invention does not require addition of any reagent or the like to the waste and therefore is free from any possibility of increasing the amount of waste.

As is clear from the example given above, the method of the present invention permits palladium to be selectively separated and removed from a solution containing both palladium and ruthenium. In the art of eliminating ruthenium from radioactive liquid waste containing such fission products as ruthenium and palladium, palladium has been a deterrent where, for example, ruthenium is to be removed by electrolytic oxidation extraction. However, when palladium alone has been selectively removed in advance by using the method of the present invention, ruthenium can be effectively removed. Thus, the combination of the present invention with the conventional method for the ruthenium removal by oxidation is quite effective.

The present invention is not limited to the recovery of palladium from radioactive liquid waste, but applicable as well to the recovery of palladium from ordinary aqueous solutions containing palladium.

While the present invention has been described with respect to preferred embodiments, it should be apparent to those skilled in the art that numerous modifications may be made thereto without departing from the scope of the invention.

What is claimed is:

1. An apparatus for recovering palladium by electrolysis comprising:

a dc electrolytic cell capable of recovering therein a palladium-containing aqueous solution acidified with nitric acid and equipped with an anode disposed in said cell, a dc supply connected to said anode and a first contact;

a recovery vessel capable of receiving therein dilute nitric acid and equipped with a mechanical shaker for shaking said recovery vessel, a counter electrode disposed in said recovery vessel, an ac supply connected to said counter electrode and a second contact; and an electrode-transferring mechanism having a drive shaft capable of rotating and moving upward and downward and a pair of arms extending form said drive shaft horizontally in opposite directions, said electrode-transferring mechanism being equipped with a pair of platinum cathodes each suspended perpendicularly from said arm via a platinum wire so that said cathodes are inserted into said electrolytic cell and said recovery vessel, respectively, in such a manner that the respective cathodes are changed in their positions alternately, and the respective ends of arms are electrically connected to said first and second contacts alternately, at predetermined intervals of time.

2. The apparatus according to claim 1, wherein each of said platinum cathodes consists of a platinum or platinum-plated inert metal network formed into a slender cylindrical shape.

3. The apparatus according to claim 1, wherein said anode disposed in said electrolytic cell is formed of a cylindrical gauze of platinum, and wherein said cathode is inserted into the center of said cylindrical anode.

4. The apparatus according to claim 1, wherein said counter electrode disposed in said recovery vessel is made of platinum, and wherein said cathode is inserted opposite to said counter electrode.

5. The apparatus according to claim 1, wherein said mechanical shaker comprises an ultrasonic vibrator attached at the outside of the bottom of said recovery vessel.

* * * * *